US010355394B2

(12) United States Patent
Zhang

(10) Patent No.: US 10,355,394 B2
(45) Date of Patent: Jul. 16, 2019

(54) ELECTRICAL CONNECTOR WITH A RELIABLE WATERPROOF PERFORMANCE

(71) Applicant: Molex, LLC, Lisle, IL (US)

(72) Inventor: Xue-Hai Zhang, Kunshan (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/981,419

(22) Filed: May 16, 2018

(65) Prior Publication Data

US 2018/0337488 A1 Nov. 22, 2018

(30) Foreign Application Priority Data

May 22, 2017 (CN) ..... 2017 2 0573388 U

(51) Int. Cl.

| | |
|---|---|
| ***H01R 13/648*** | (2006.01) |
| ***H01R 13/52*** | (2006.01) |
| ***H01R 12/71*** | (2011.01) |
| ***H01R 13/6581*** | (2011.01) |
| ***H01R 43/18*** | (2006.01) |
| ***H01R 12/72*** | (2011.01) |
| *H01R 12/70* | (2011.01) |
| *H01R 13/62* | (2006.01) |
| *H01R 13/6585* | (2011.01) |

(52) U.S. Cl.

CPC ..... *H01R 13/5202* (2013.01); *H01R 12/716* (2013.01); *H01R 12/725* (2013.01); *H01R 13/521* (2013.01); *H01R 13/5219* (2013.01); *H01R 13/6581* (2013.01); *H01R 43/18* (2013.01); *H01R 12/707* (2013.01); *H01R 13/62* (2013.01); *H01R 13/6585* (2013.01)

(58) Field of Classification Search

CPC ..... H01R 23/7073; H01R 13/5219; H01R 23/688; H01R 23/6873

USPC ..... 439/79, 271, 607.11, 607.35, 607.4, 660

See application file for complete search history.

(56) References Cited

U.S. PATENT DOCUMENTS

| | | | | |
|---|---|---|---|---|
| 8,827,742 | B2 * | 9/2014 | Wang | H01R 24/68 439/569 |
| 9,209,573 | B1 * | 12/2015 | Chen | H01R 13/6581 |
| 9,281,608 | B2 * | 3/2016 | Zhao | H01R 12/57 |
| 9,281,643 | B1 * | 3/2016 | Tseng | H01R 13/518 |
| 9,385,484 | B2 * | 7/2016 | Chen | H01R 13/6594 |
| 9,391,391 | B2 * | 7/2016 | Chien | H01R 13/5202 |

(Continued)

FOREIGN PATENT DOCUMENTS

| | | |
|---|---|---|
| CN | 102820579 A | 12/2012 |
| CN | 104868290 A | 8/2015 |

*Primary Examiner* — Thanh Tam T Le

(74) *Attorney, Agent, or Firm* — Molex, LLC

(57) ABSTRACT

An electrical connector is provided which has a reliable waterproof performance. The electrical connector has an insulated body having a housing, a plurality of conductive terminals, a metal shell, two fixed plates, and a waterproof adhesive. The plurality of conductive terminals are fixed to the insulative body. The insulated body is inserted into a cavity of the metal shell from back to front. The two fixed plates are respectively mounted on two opposite sides of the housing. Each fixed plate has a fixed portion and a holding portion bent downwardly from a rear side of the fixed portion. A rear side of the housing is held by the holding portions. The waterproof adhesive is coated on the holding portion and the rear side of the housing to form an overall seal on a rear portion of the cavity.

10 Claims, 7 Drawing Sheets

(56) References Cited

U.S. PATENT DOCUMENTS

| | | | | |
|---|---|---|---|---|
| 9,496,664 | B2 * | 11/2016 | Little | H01R 13/6587 |
| 9,640,899 | B2 | 5/2017 | Kim et al. | |
| 9,673,569 | B2 * | 6/2017 | Zhang | H01R 13/6585 |
| 9,711,910 | B2 * | 7/2017 | Zhao | H01R 13/6581 |
| 9,742,098 | B2 * | 8/2017 | Zhao | H01R 13/5202 |
| 9,871,318 | B2 * | 1/2018 | Wang | H01R 13/5202 |
| 9,935,393 | B2 * | 4/2018 | Tada | H01R 12/724 |
| 2015/0244111 | A1 * | 8/2015 | Ju | H01R 13/6585 439/607.05 |

* cited by examiner

ELECTRICAL CONNECTOR WITH A RELIABLE WATERPROOF PERFORMANCE

RELATED APPLICATIONS

This application claims priority to Chinese Application No. 201720573388.3, filed May 22, 2017, which is incorporated herein by reference in its entirety.

TECHNICAL FIELD

The present disclosure relates to an electrical connector, and more specifically to an electrical connector with a reliable waterproof performance.

BACKGROUND ART

Chinese patent application No. CN201510085100.3 discloses a receptacle assembly, the receptacle assembly comprises: a plurality of contact pins; an inner molded member formed to retain the contact pins and in which a portion of the contact pins is embedded; an outer molded member was molded to cover the inner molded member; a shell into which the outer molded member is inserted and forming an exterior of the receptacle assembly; a sealing member positioned and compressed between the outer molded member and the shell to seal a gap between the outer molded member and the shell; and a retaining plate positioned to an outer side of the outer molded member to compressively retain the outer molded member to the shell. The retaining plate comprises a fastening end, the fastening end extends from the retaining plate along a direction that the outer molded member is fastened to the shell to apply a pressure to the outer molded member, so that the outer molded member is fastened to the shell. The retaining plate of the receptacle assembly needs to apply a press to compress and retain the outer molded member, however when the impact subjected, the retaining plate is easily loosened and detached, which results in that the sealing member cannot be pressed tightly and in turn a waterproof performance of the connector is not reliable enough, so it is really necessary to make improvement.

SUMMARY

A technical problem to be resolved by the present disclosure is to provide an electrical connector with a reliable waterproof performance so as to overcome the deficiency in the prior art.

In view of the above technical problem, the present disclosure provides an electrical connector comprising: an insulated body which comprises a housing and a tongue extending forwardly from the housing; a plurality of conductive terminals fixed to the insulated body, each conductive terminal comprises a mating portion exposed to a surface of the tongue, a soldering portion extending backwardly out of the insulated body and a connecting portion connected between the mating portion and the soldering portion; a metal shell surrounding and forming a cavity penetrating along a front-back direction, at least one blocking protrusion protrudes from a middle of the metal shell into the cavity, and the cavity is divided into a mating cavity and a receiving cavity along the front-back direction by the blocking protrusion; the insulated body is inserted into the cavity from back to front, a front side of the housing is stopped by the blocking protrusion; at least one fixed plate mounted on the housing, the fixed plate comprises a fixed portion and a first holding portion bent downwardly from a rear side of the fixed portion, the fixed portion is fixed to the metal shell, the first holding portion holds a rear side of the housing; and a waterproof adhesive coated on the first holding portion and the rear side of the housing, so that an overall seal is achieved in a rear portion of the receiving cavity.

Compared with the prior art, in the electrical connector of the present disclosure, the fixed plates are engaged with the metal shell by mounting the fixed plates to the housing of the insulated body and then using a method such as the laser welding, the insulated body can be positioned along the front-back direction relative to the metal shell by means of the first holding portions of the fixed plates and the blocking protrusions of the metal shell, and then the overall seal is achieved on the rear portion of the receiving cavity by coating the waterproof adhesive on the rear end of the housing, so a waterproof performance is reliable.

DETAILED DESCRIPTION OF THE PREFERRED EMBODIMENTS

While the present disclosure may be susceptible to embodiments in different forms, there are shown in the Figures, and will be described herein in detail, are only specific embodiments, with the understanding that the present disclosure is to be considered as an exemplification of the principles of the present disclosure, and is not intended to limit the present disclosure to that as illustrated.

As such, references to a feature are intended to describe a feature of an example of the present disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various parts of the present disclosure, are not absolute, but relative. These representations are appropriate when the parts are in the position shown in the figures. If the description of the position of the parts changes, however, these representations are to be changed accordingly.

Hereinafter, embodiments of the present disclosure will be further described in detail in combination with the figures.

Figure 1:
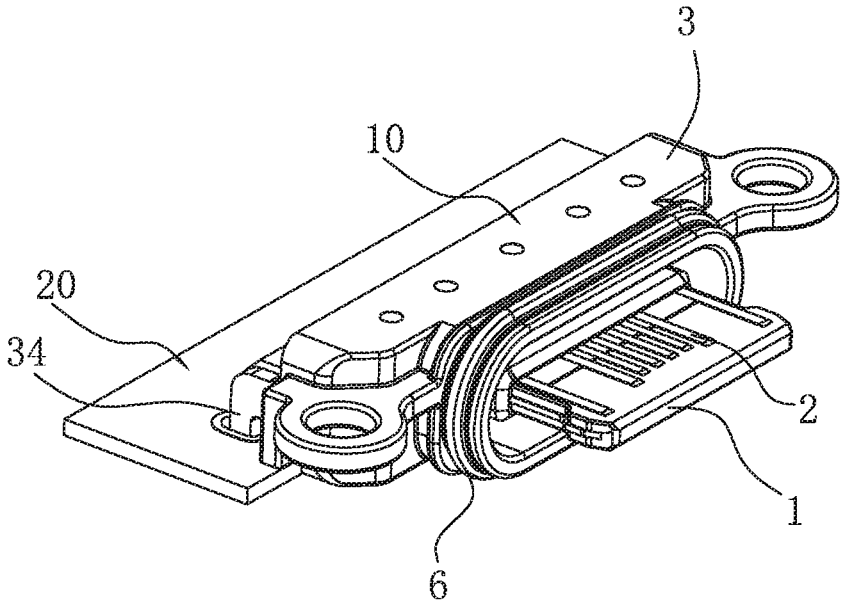
FIG. 1 is a perspective view of an embodiment of an electrical connector of the present disclosure and a circuit board.
Figure 2:
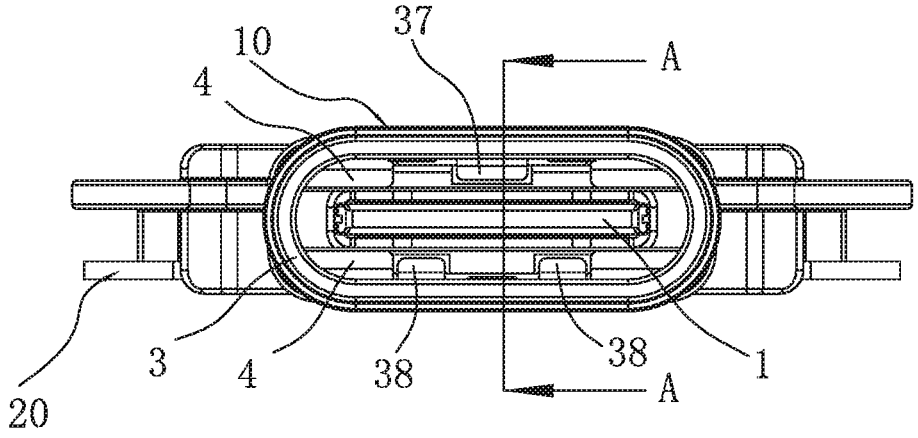
FIG. 2 is a front view of FIG. 1.
Figure 3:
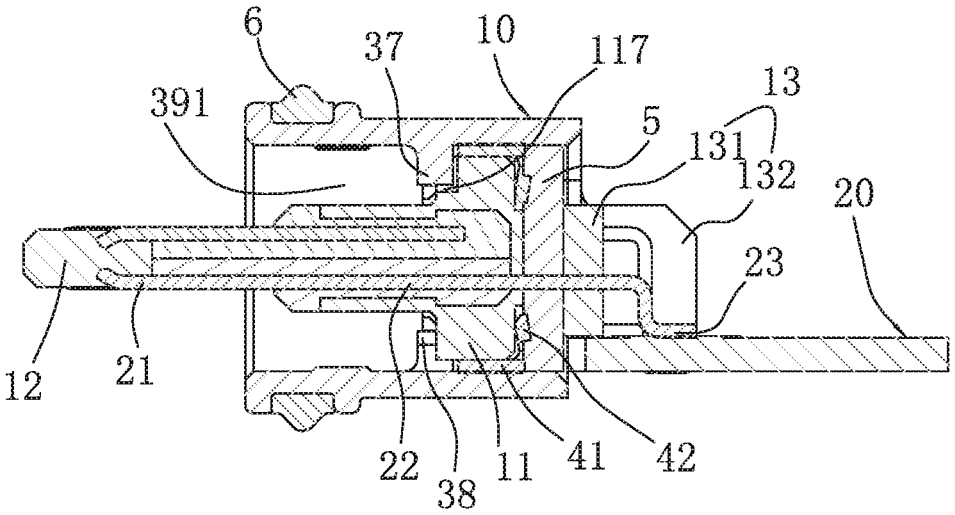
FIG. 3 is a cross-sectional view taken along a line A-A in FIG. 2.

Referring to FIG. 1, FIG. 2 and FIG. 3, the present disclosure provides a waterproof electrical connector 10, the electrical connector 10 is mounted on the circuit board 20 by the way of sinking mount.

Combination with referring to FIG. 4 to FIG. 9, the electrical connector 10 comprises: an insulated body 1, a plurality of conductive terminals 2 fixed to the insulated body 1, a metal shell 3 sheathed on a periphery of the insulated body 1, two fixed plates 4 respectively mounted to an upper side and a lower side of the insulated body 1, a waterproof adhesive 5 provided to a rear end of the metal shell 3, and a sealing ring 6 sheathed on a periphery of a front end of the metal shell 3.

The insulated body 1 is preferably engaged with the conductive terminals 2 by using an insert molding process. The insulated body 1 comprises a housing 11, a tongue 12 extending forwardly from the housing 11 and a terminal positioning block 13 provided behind the housing 11.

Figure 6:
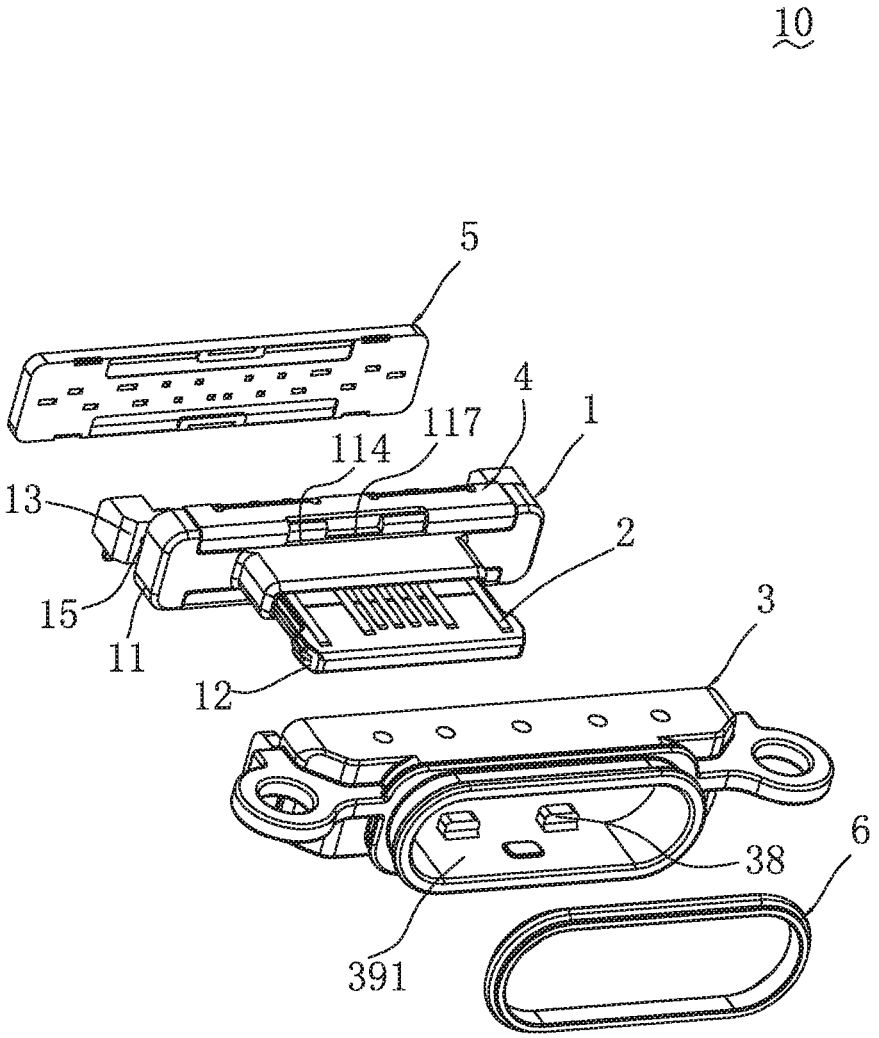
FIG. 6 and FIG. 7 are further exploded perspective views based on FIG. 5 from two different view angles.
Figure 8:
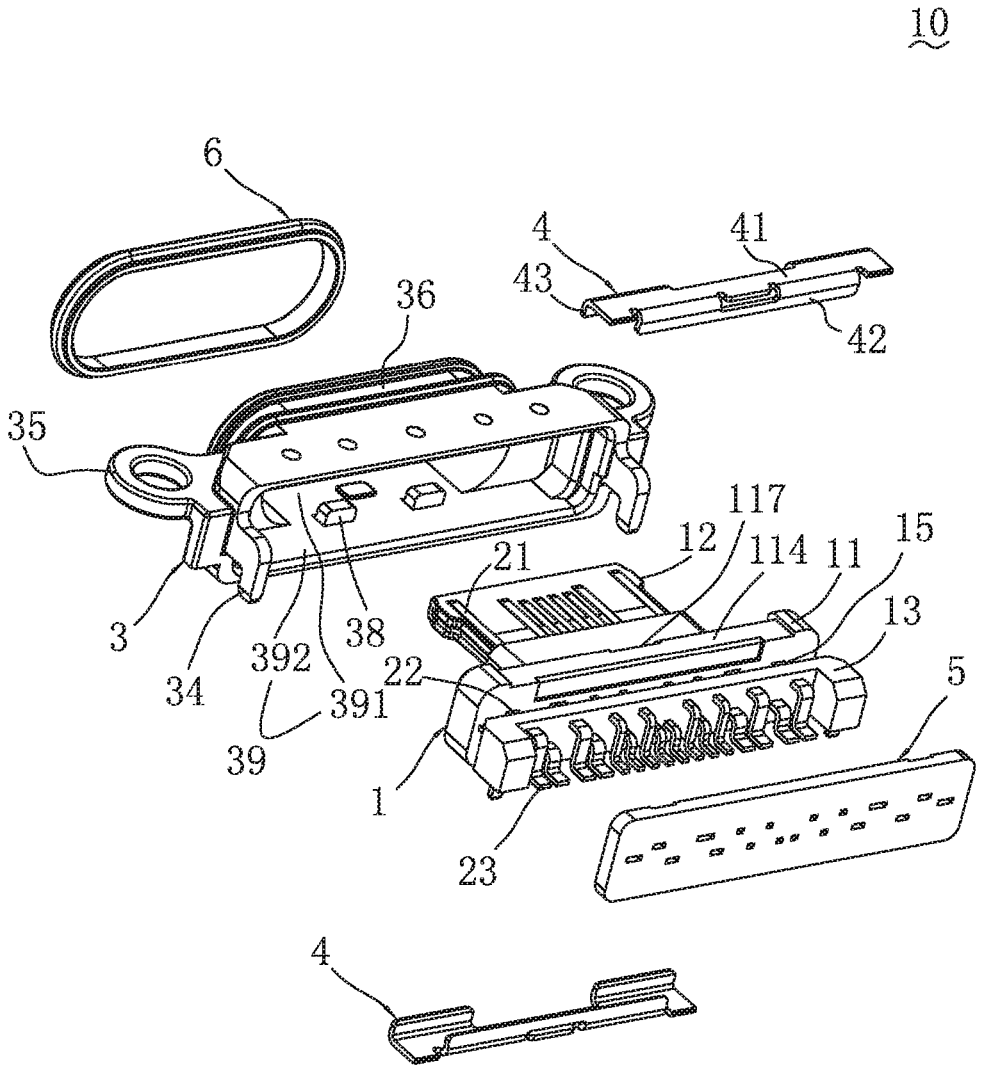
FIG. 8 and FIG. 9 are further exploded perspective views based on FIG. 7 from two different view angles.
Figure 9:
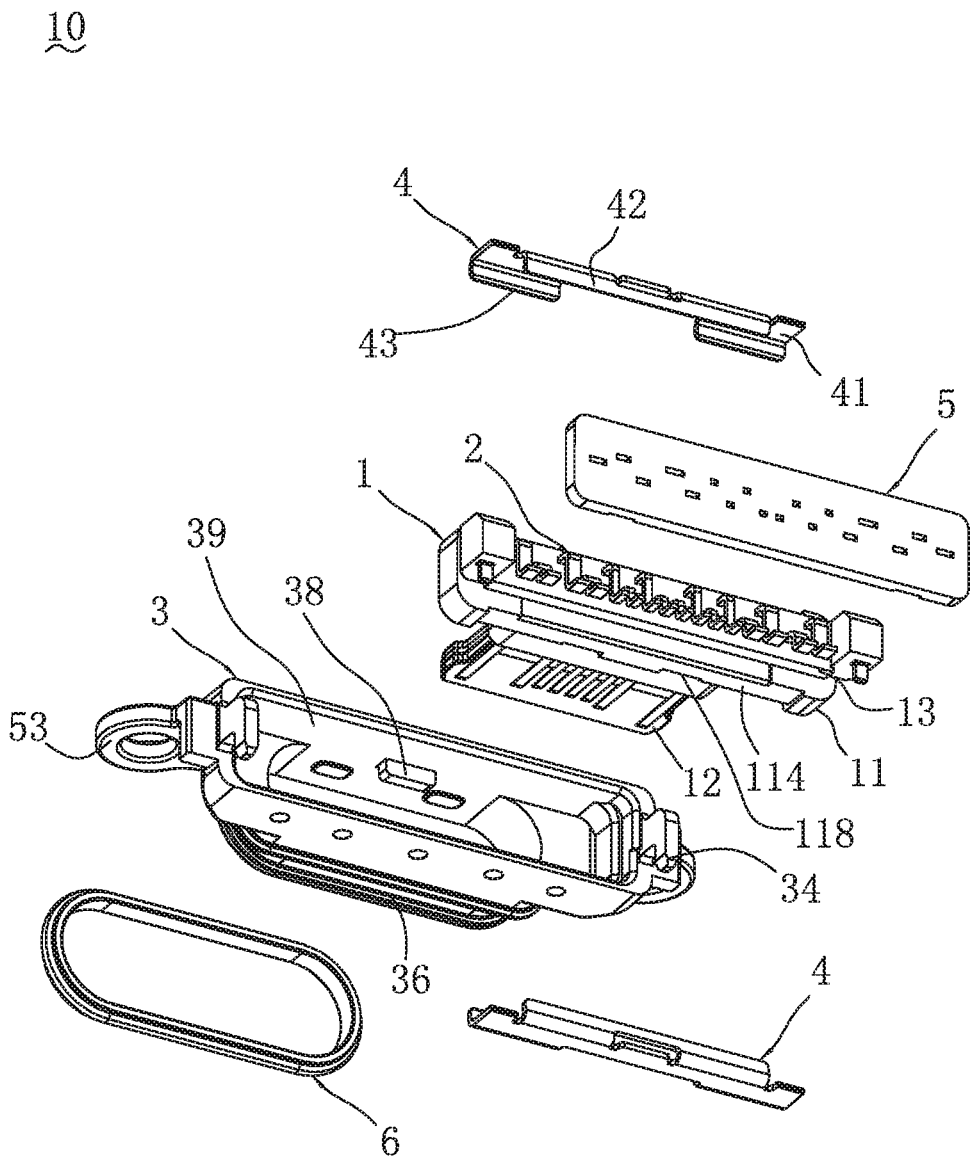

The upper side and the lower side of the housing 11 each are provided with a U-shaped mounting groove 114 for correspondingly mounting the fixed plate 4. Referring to FIG. 6 and FIG. 8, a middle of a front side of the mounting groove 114 on an upper side is recessed with a positioning groove 117. Referring to FIG. 9, a middle of a front side of the mounting groove 114 on a lower side is recessed with two positioning grooves 118 spaced apart from each other.

Figure 4:
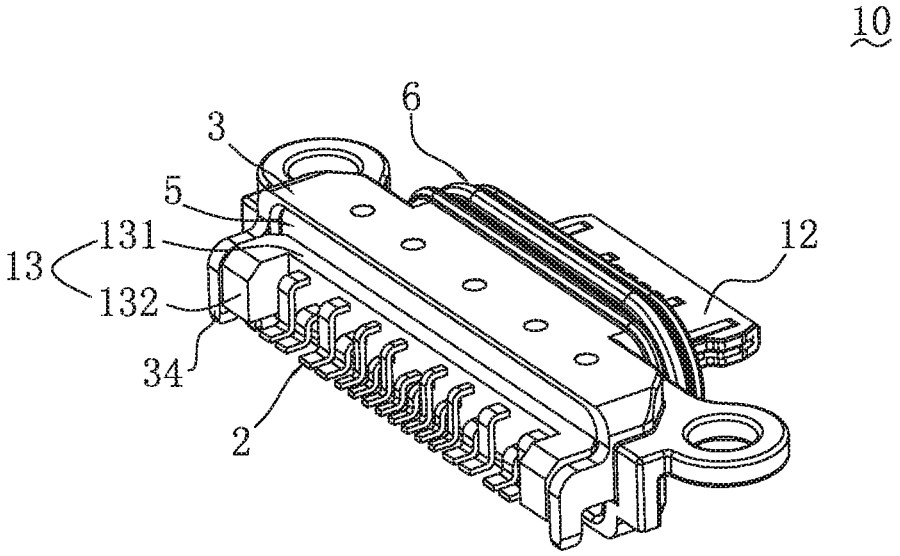
FIG. 4 is a perspective view of the embodiment of the electrical connector of the present disclosure.
Figure 5:
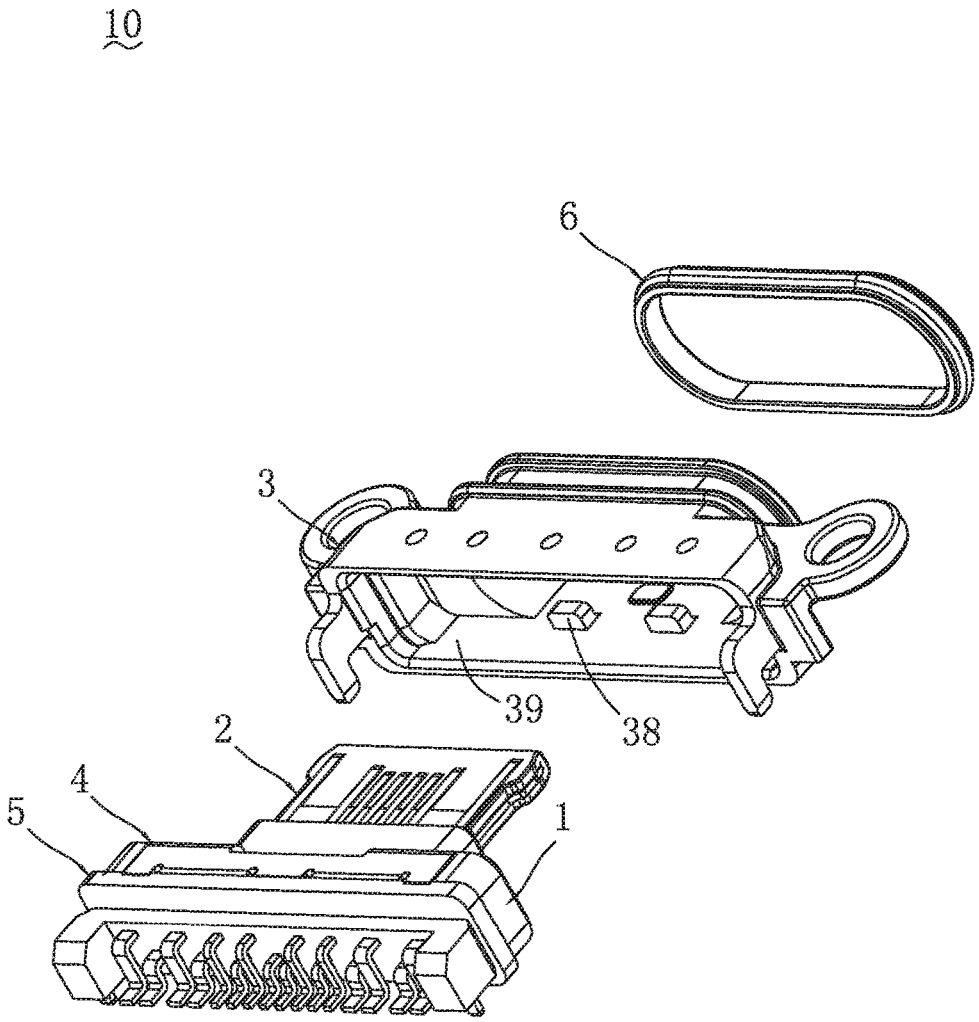
FIG. 5 is an exploded perspective view of the embodiment of the electrical connector of the present disclosure.

Referring to FIG. 4, the terminal positioning block 13 comprises a main body 131 extending transversely and two extending portions 132 respectively extending backwardly from both sides of the main body 131. The main body 131 of the terminal positioning block 13 and the housing 11 are spaced apart from each other by a distance, and an adhesive receiving groove 15 penetrating along an up-down direction and formed between the main body 131 of the terminal positioning block 13 and the housing 11. The waterproof adhesive 5 is filled in the adhesive receiving groove 15.

Each conductive terminal 2 comprises a mating portion 21 exposed to an upper surface or a lower surface of the tongue 12, a soldering portion 23 extending backwardly out of the terminal positioning block 13, and a connecting portion 22 connected between the mating portion 21 and the soldering portion 23. The connecting portions 22 of the conductive terminals 2 are partially exposed to the adhesive receiving groove 15. In addition, the soldering portions 23 are positioned between the two extending portions 132 of the terminal positioning block 13, which helps to protect the soldering portions 23 from an external collision.

The metal shell 3 is preferably made by using a metal injection molding (MIM) process. A cavity 39 penetrating along a front-back direction is surrounded and formed by the metal shell 3, three blocking protrusions 38 protrude from a middle of the metal shell 3 into the cavity 39, and the cavity 39 is divided along the front-back direction into a mating cavity 391 and a receiving cavity 392. The insulated body 1 is preferably inserted into the cavity 39 from back to front. The tongue 12 of the insulated body 1 extends forwardly out of the metal shell 3. The housing 11 of the insulated body 1 is received in the receiving cavity 392 in a rear portion of the cavity 39. The blocking protrusions 38 stop at a front side of the housing 11, and prevent the housing 11 from moving forwardly. The terminal positioning block 13 of the insulated body 1 extends backwardly out of the metal shell 3.

Referring to FIG. 2, in the embodiment, one blocking protrusion 37 and two blocking protrusions 38 are formed by respectively protruding from an upper side and a lower side of the metal shell 3 into the cavity 39. After the insulated body 1 is inserted into the metal shell 3, the blocking protrusion 37 correspondingly enters into the correspondingly positioning groove 117, the blocking protrusions 38 correspondingly enter into the correspondingly positioning grooves 118. Such a structure helps to ensure that the insulated body 1 is inserted into the cavity 39 in a correct direction. While in other embodiment, the total number and arrangement of the blocking protrusions 37, 38 can be adjusted according to the needs of actual application.

In addition, a front end of the metal shell 3 is encircled and recessed with a mounting channel 36 for correspondingly mounting the sealing ring 6. Both sides of a back portion of the metal shell 3 each are formed with a soldering leg 34 extending downwardly therefrom. The two soldering legs 34 are correspondingly provided to outer sides of the two extending portions 132 of the terminal positioning block 13, which helps to protect the two soldering legs 34 by the terminal positioning block 13. Both sides of a front portion of the metal shell 34 each are formed with a locking portion 35 horizontally extending outwardly therefrom, the locking portion 35 is provided with a locking hole 351 for locking the electrical connector 10 and a case of an electronic device (not shown in figures, such as a case of a mobile phone) together, and strengthening the engaging strength and prevent shaking.

The fixed plate 4 is formed by integrally bending a metal plate, and the fixed plate 4 is substantially U-shaped, and correspondingly mounted to the mounting groove 114 of the housing 11. The fixed plate 4 comprises a fixed portion 41, a first holding portion 42 bent downwardly from a rear side of the fixed portion 41, and a second holding portion 43 bent downwardly from a front side of the fixed portion 41.

In the embodiment, the first holding portion 42 is preferably a single-piece structure, and correspondingly received in the rear side of the mounting groove 114. The second holding portion 43 is preferably a structure of two pieces spaced apart from each other, and correspondingly received in the front side of the mounting groove 114. The second holding portion 43 and the first holding portion 42 cooperate to position and mount the fixed plate 4 on the housing 11 along the front-back direction. The second holding portion 43 can be omitted in some embodiments (not shown in figures). It is noted that, although there are two the fixed plates 4 in the embodiment, but in some embodiments (not shown in figures), there may be only one fixed plate 4, or the two fixed plates are integrally connected in the up-down direction (not shown in figures).

It is noted that the blocking protrusions 37, 38 of the metal shell 3 in the embodiment only abut against the housing 11 of the insulated body 1, and there is no mutual interference between the blocking protrusions 37, 38 and the fixed plates 4, which helps to define a position relationship between the insulated body 1 and the metal shell 3.

An outer side of the fixed portion 41 is attached to an inner wall of the metal shell 3, and both are engaged together by a laser welding. The first holding portion 42 holds a rear side of the housing 11, which helps to prevent the insulated body 1 from moving backwardly relative to the metal shell 3.

The waterproof adhesive 5 is coated on the first holding portions 42 and the rear side of the housing 11, so that an overall seal is achieved to the rear portion of the receiving cavity 392. Specifically, the waterproof adhesive 5 is filled in the adhesive receiving groove 15, and also used for sealing a tiny crack formed between the conductive terminals 2 and the insulated body 1 due to different materials and under an effect of thermal expansion and contraction, the waterproof adhesive 5 is adhered with the metal shell 3, the insulated body 1, the conductive terminals 2 and the first holding portions 42 of the fixed plates 4, thereby totally sealing a rear end of the receiving cavity 392 to prevent external water from infiltrating backwardly onto the circuit board 20 along the mating cavity 391.

Figure 7:
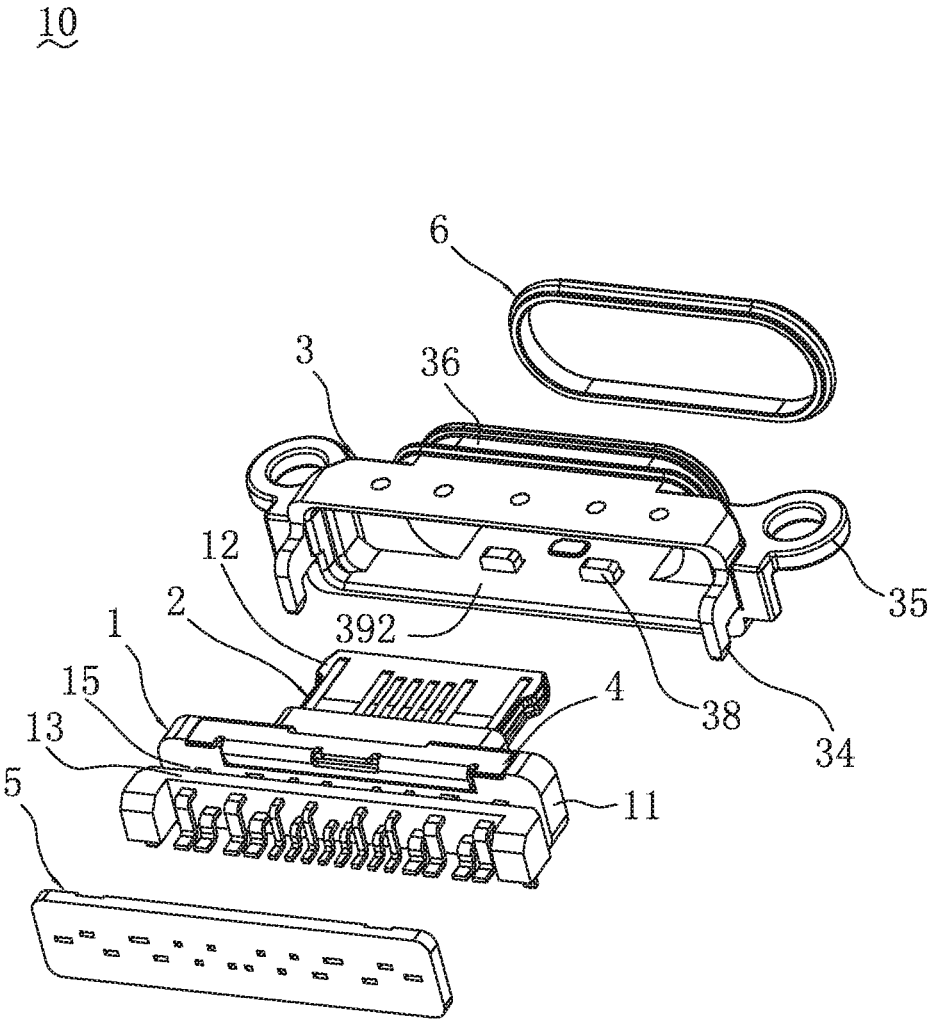

Referring to FIG. 3, FIG. 6 and FIG. 7, the sealing ring 6 is mounted in the mounting channel 36 of the metal shell 3, so as to prevent the sealing ring 6 from sliding along the front-back direction. The sealing ring 6 and the case of the electronic device (not shown in figures, such as a case of a mobile phone) cooperate with each other and can better prevent external water from infiltrating backwardly into the electronic device along a gap between the metal shell 3 and the case of the electronic device.

A manufacturing and assembling process of the electrical connector 10 generally comprises following steps of: using an insert molding process to obtain the insulated body 1 engaged with the conductive terminals 2; respectively mounting the two fixed plates 4 to the upper side and the lower side of the housing 11 of the insulated body 1; inserting the insulated body 1 into the cavity 39 of the metal shell 3 from back to front; engaging the metal shell 3 with the fixed portions 41 of the two fixed plates 4 by the laser welding, so as to fix the insulated body 1; coating the waterproof adhesive 5 on the rear end of the housing 11 of the insulated body 1, so as to fully seal the rear end of the receiving cavity 392; finally, sheathing the sealing ring 6 on the periphery of the front end of the metal shell 3.

Compared with the prior art, in the electrical connector 10 of the present disclosure the fixed plates 4 are engaged with the metal shell 3 by mounting the fixed plates 4 to the housing 11 of the insulated body 1 and then using a method such as the laser welding, the insulated body 1 can be positioned along the front-back direction relative to the metal shell 3 by means of the first holding portions 42 of the fixed plates 4 and the blocking protrusions 37, 38 of the metal shell 3, and then the overall seal is achieved on the rear portion of the receiving cavity 392 by coating the waterproof adhesive 5 on the rear end of the housing 11, so a waterproof performance is reliable.

The above described contents are only the embodiments of the present disclosure, which cannot limit the implementing solutions of the present disclosure, those skilled in the art may conveniently make corresponding variation or modification based on the main concept and spirit of the present disclosure, therefore the extent of protection of the present disclosure shall be determined by terms of the Claims.

What is claimed is:

1. An electrical connector comprising:

an insulated body which comprises a housing and a tongue extending forwardly from the housing;

a plurality of conductive terminals fixed to the insulated body, each conductive terminal comprising a mating portion exposed to a surface of the tongue, a soldering portion extending backwardly out of the insulated body and a connecting portion connected between the mating portion and the soldering portion;

a metal shell surrounding and forming a cavity penetrating along a front-back direction, at least one blocking protrusion protruding from a middle of the metal shell into the cavity, and the cavity being divided into a mating cavity and a receiving cavity along the front-back direction by the at least one blocking protrusion, the insulated body being inserted into the cavity from a back to front, a front side of the housing being stopped by the at least one blocking protrusion;

at least one fixed plate mounted on the housing, the at least one fixed plate comprising a fixed portion and a first holding portion bent from a rear side of the fixed portion, the fixed portion being fixed to the metal shell, the first holding portion being configured to hold a rear side of the housing; and a waterproof adhesive coated on the first holding portion and the rear side of the housing, so that an overall seal is achieved in a rear portion of the receiving cavity.

2. The electrical connector according to claim 1, wherein the at least one fixed plate comprises two fixed plates , the two fixed plates respectively being fixed to two opposite sides of the housing.

3. The electrical connector according to claim 2, wherein each of the two fixed plates are U-shaped and further each comprise a second holding portion bent from a front side thereof.

4. The electrical connector according to claim 3, wherein an upper side and a lower side of the housing are respectively provided with mounting grooves for mounting the two fixed plates respectively.

5. The electrical connector according to claim 2, wherein each of the fixed plates are formed by integrally bending a metal plate, wherein the fixed portion of each fixed plate extends parallel to the tongue, and each fixed portion is engaged with the metal shell by a laser welding.

6. The electrical connector according to claim 1, wherein the front side of the housing is recessed with a positioning groove cooperating with the at least one blocking protrusion of the metal shell.

7. The electrical connector according to claim 1, wherein the at least one blocking protrusion protrudes from each of an upper side and a lower side of the metal shell into the cavity.

8. The electrical connector according to claim 1, wherein the insulated body further comprises a terminal positioning block provided behind the housing, an adhesive receiving groove penetrating along an up-down direction is formed between the terminal positioning block and the housing, the connecting portions of the conductive terminals are exposed to the adhesive receiving groove, the waterproof adhesive is filled in the adhesive receiving groove.

9. The electrical connector according to claim 8, wherein both sides of the terminal positioning block each are respectively formed with an extending portion extending backwardly therefrom, the soldering portions of the conductive terminals are positioned between the two extending portions of the terminal positioning block, both sides of the rear portion of the metal shell are respectively formed with a soldering leg extending downwardly therefrom, the two soldering legs are respectively provided on outer sides of the two extending portions.

10. The electrical connector according to claim 1, wherein the metal shell is made by a metal injection molding process, a front end of the metal shell is encircled and recessed with a mounting channel for correspondingly mounting a sealing ring, both sides of a front portion of the metal shell each are formed with a locking portion extending outwardly therefrom.

* * * * *